US009055380B2

(12) United States Patent
van Hal et al.

(10) Patent No.: US 9,055,380 B2
(45) Date of Patent: Jun. 9, 2015

(54) METHOD FOR PRODUCING A TUBE FOR A HEARING AID

(71) Applicant: Sonion Nederland B.V., Amsterdam (NL)

(72) Inventors: Paul Christiaan van Hal, Amsterdam (NL); Theodorus Geradus Maria Brouwer, Heemstede (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 13/685,878

(22) Filed: Nov. 27, 2012

(65) Prior Publication Data

US 2013/0136284 A1 May 30, 2013

Related U.S. Application Data

(60) Provisional application No. 61/564,011, filed on Nov. 28, 2011.

(30) Foreign Application Priority Data

Nov. 28, 2011 (DK) ..... 2011 00926

(51) Int. Cl.
*H04R 25/00* (2006.01)

(52) U.S. Cl.
CPC ..... *H04R 25/608* (2013.01); *H04R 25/65* (2013.01); *H04R 25/60* (2013.01); *H04R 2225/021* (2013.01)

(58) Field of Classification Search
CPC ..... H04R 25/556; H04R 25/55; H04R 25/60; H04R 25/65; H04R 25/658; H04R 1/10; H04R 1/1033; H04R 1/1066; H04R 2225/021; H04R 2225/63
USPC ..... 381/312, 322, 328–329, 384; 156/293; 29/592, 592.1, 594
See application file for complete search history.

(56) References Cited

U.S. PATENT DOCUMENTS

| | | | | |
|---|---|---|---|---|
| 3,328,229 | A * | 6/1967 | Windecker | 156/66 |
| 6,522,765 | B1 * | 2/2003 | Towle | 381/370 |
| 8,556,664 | B2 * | 10/2013 | Aase | 439/668 |
| 2011/0094718 | A1 | 4/2011 | yang | |
| 2011/0135131 | A1 * | 6/2011 | Winther | 381/322 |
| 2013/0136286 | A1 * | 5/2013 | Christensen et al. | 381/330 |

* cited by examiner

*Primary Examiner* — Ahmad F Matar
*Assistant Examiner* — Sabrina Diaz
(74) *Attorney, Agent, or Firm* — Nixon Peabody LLP

(57) ABSTRACT

A method for producing a tube for a hearing aid is disclosed. And more specifically, a method is disclosed for anchoring a fiber to a tube of a hearing aid, the fiber running through the tube. The fiber is positioned within the tube as a reinforcement fiber to improve the pull strength of the tube.

19 Claims, 3 Drawing Sheets

METHOD FOR PRODUCING A TUBE FOR A HEARING AID

CROSS-REFERENCE TO RELATED APPLICATIONS

This application claims the benefit of U.S. Provisional Patent Application Ser. No. 61/564,011,filed Nov. 28, 2011, and titled "Method for Producing a Tube for a Hearing Aid," and Danish Patent Application Serial No. PA 2011 00926, filed Nov. 28, 2011, and titled "Method for Producing a Tube for a Hearing Aid" both of which are incorporated herein by reference in their entireties.

FIELD OF THE INVENTION

The present invention relates to a method for producing a tube for a hearing aid. In particular the present invention relates to, a method for providing a fiber reinforced tube for a hearing aid. The fiber is positioned within the tube as a reinforcement fiber to improve the pull strength of the tube.

BACKGROUND OF THE INVENTION

In hearing aids the sound produced is to be delivered to the ear of the wearer of the hearing aid. Thereto a hollow tube is provided for delivering the acoustic signal to that part of the hearing aid which is located in the ear. This requires a tube of a certain diameter that is clearly visible to other people. In RIC hearing aids electrical signals are delivered from a behind-the-ear (BTE) part to the Receiver-in-canal (RIC) part of the hearing aid. This allows for a much smaller tube containing the wires for conducting the signals. The trend is to make the diameter of these tubes as small as possible, but the problem then is that the strength of the tubing is also reduced, and as a consequence robustness is not sufficient anymore. To address this Estron has developed a method for providing an extruded cable "Eslinum" that allows extruding the insulation material tight around the wires, while facilitating stripping of the insulation without damaging the wires. The tensile strength is improved by improved by applying Aramide fibers. This is results in a strong cable with a small diameter, which in contrast to a tube, is not hollow. Though this prevents acoustical feedback and entering of sweat, moisture or ear wax to the inside of the cable, it does not prevent the wires from experiencing stress or tension when pulling or bending forces are exerted on the cable; e.g. when the cable is pulled at one end. In U.S. Patent Application Publication No. 2011/0094718, this is addressed by providing a hollow tube carrying a conductor wherein the conductor has a length exceeding that of the tube. The conductor carries one or more electrical wires and is spirally preformed. As the tube is hollow, the conductor is free to move and does not experience stress or tension when pulling or bending forces are exerted upon the tube. However, this puts a limit on the minimal diameter of the tube and requires preforming of the conductor.

It is an object of one or more embodiments of the present invention to provide a method for producing a tube for a hearing aid in that alleviates the above drawbacks.

SUMMARY OF INVENTION

The present invention relates to a method for manufacturing a tube for a hearing aid, the method comprising:

providing a tube of a predetermined length, the tube defining a first tube end and an opposite second tube end;

providing a fiber having a length which exceeds the predetermined length of the tube, the fiber defining a first fiber end and an opposite second fiber end;

inserting the fiber into the tube such that the fiber ends extend out through at least one of the tube ends;

anchoring at least one of the fiber ends at the respective tube end through which it extends.

In one embodiment, the step of 'anchoring at least one of the fiber ends', comprises the steps of:

placing the respective fiber end around the respective tube end; and fixating the respective fiber end to the respective tube end.

The step of 'placing the respective fiber end around the respective tube end' may be carried out such that the respective fiber encirculates the respective tube end one time or two times, or three times, or four times. In one, embodiment, the respective fiber encirculates the tube end by 360 degrees (i.e. the fiber encirculates the respective tube end one time), or 300 degrees or 270 degrees, or 240 degrees, or 210 degrees, or 180 degrees, or 150 degrees, or 120 degrees, or 90 degrees, or 60 degrees. In one embodiment, the fiber is split up in a first set of filaments and a second set of filaments, the first set encirculating the respective tube end clockwire, while the second set encirculates the respective tube end counter-clockwise.

Fixating or securing the fiber end to the respective tube end may be performed by gluing i.e. by providing an adhesive between the fiber end and the tube end. The adhesive may be provided on an outer surface of the tube end and/or on an outer surface of the fiber end. Alternatively, or as a supplement, the fiber end may be welded to the tube end, e.g. by means of laser welding, or ultrasonic welding. Alternatively, or as a supplement, the fiber end may be secured/fixated to the tube end by application of heat/thermal energy. In one embodiment, the heat causes the fiber end and the tube end to melt together. In another embodiment, the heat causes an added material to secure the fiber end and the tube end to to each other, this added material may be an adhesive or a soldering material.

Securing the fiber to the tube causes the resulting hollow tube to be reinforced due to the presence of the fiber. Accordingly, when the tube ends are subjected to a tensile force, the ability of the tube to stretch is limited by the fiber as the fiber in most cases will have a better tensile strength than the tube. When the tube of the present invention is used in a hearing aid for encompassing the electrical wires interconnecting the BTE and RIC parts, the electrical wires are capable of freely moving within the hollow tube when force is exerted on the tube. As the fiber may be anchored on the outside of the tube, the tube end openings remain accessible and allow insertion of the electrical wires therein after manufacturing of the tube.

In one embodiment, the step of 'anchoring at least one of the fiber ends' further comprises the step (which is performed prior to the step of 'placing the respective fiber end around the respective tube end'):

fraying the fiber end into filaments.

By 'fraying the fiber' shall be understood that the fiber is divided into two or more groups of filaments. In one embodiment, the fiber is divided into each of the separate filaments. It will be appreciated that in most embodiments, only the fiber ends are divided into filaments while the remaining parts of the fiber is un-frayed/un-divided.

Moreover, the step of 'placing the respective fiber end around the respective tube end' may comprise the step of:

positioning the filaments against the tube end.

In one embodiment, this is done by bringing the filaments into physical contact with an outer surface of the tube end, whereby the filaments and the outer surface of the tube end abut each other.

In a further embodiment, the step of 'anchoring each of the fiber ends' comprises the step (which is performed prior to 'fixating the respective fiber end to the respective tube end'):

forming the fiber end in a loop; and placing the loop around the respective tube end.

In one embodiment, the loop is defined prior to being placed around the tube end. In another embodiment, the fiber is initially brought into contact with the tube end and subsequently, a loop is defined.

If the tube end is frayed in filaments, the filaments are formed in a loop either in a single bundle or as multiple bundles of filaments.

In one embodiment, the step of 'anchoring at least one of the fiber ends' comprises the step (which is performed subsequent to the step of 'placing the loop around the respective tube end'):

tightening the loop so as to tie the fiber to the respective tube end by means of a knot defined by the tied loop.

In another embodiment, the step of 'fixating the fiber end to the tube end' is performed by gluing and/or welding and/or soldering and/or heating. Prior to fixating the fiber end to the tube, the filaments than can be positioned between the slits of the tube. The slits may extend in the longitudinal direction of the tube. The slits may be substantially straight, or curved or other trajectory, as they start at the edge of the tube end.

In yet another embodiment at least one tube end is provided with a flange. The flange may in addition be provided with sealing pins or with slits. Consecutively the filaments are positioned between the sealing pins or the slits respectively prior to fixating the fiber end to the tube end.

In one embodiment, the outer diameter of the tube is below 5 mm, such as below 4 mm, such as below 3 mm, such as below 2 mm, such as below 1 mm, such as below 0.5 mm, such as below 0.2 mm.

In one embodiment, the length of the tube is 10-100 mm, such as 30-70 mm. In one embodiment, the tube is 10 mm, or 20 mm, or 30 mm, or 40 mm, or 50 mm, or 60 mm, or 70 mm, or 80 mm, or 90 mm, or 100 mm.

In one embodiment, the fiber is 10 percent longer than the tube, such 20 percent longer, such as 30 percent longer, such as 40 percent longer, such as 50 percent longer. In one embodiment, the length of the fiber is 10-150 mm, such as 30-120 mm. In one embodiment, the length of the fiber is 20 mm, or 30 mm, or 40 mm, or 50 mm, or 60 mm, or 70 mm, or 80 mm, or 90 mm, or 100 mm, or 110 mm, or 120 mm, or 130 mm, or 140 mm, or 150 mm.

In one embodiment, the dimension of the flange in a direction transverse to the longitudinal direction of the tube is 0.5-3 mm, such as 1.0-1.5 mm.

BRIEF DESCRIPTION OF THE DRAWINGS

The invention will now be described with reference to the figures in which.

DETAILED DESCRIPTION OF PREFERRED EMBODIMENTS

Figure 1:
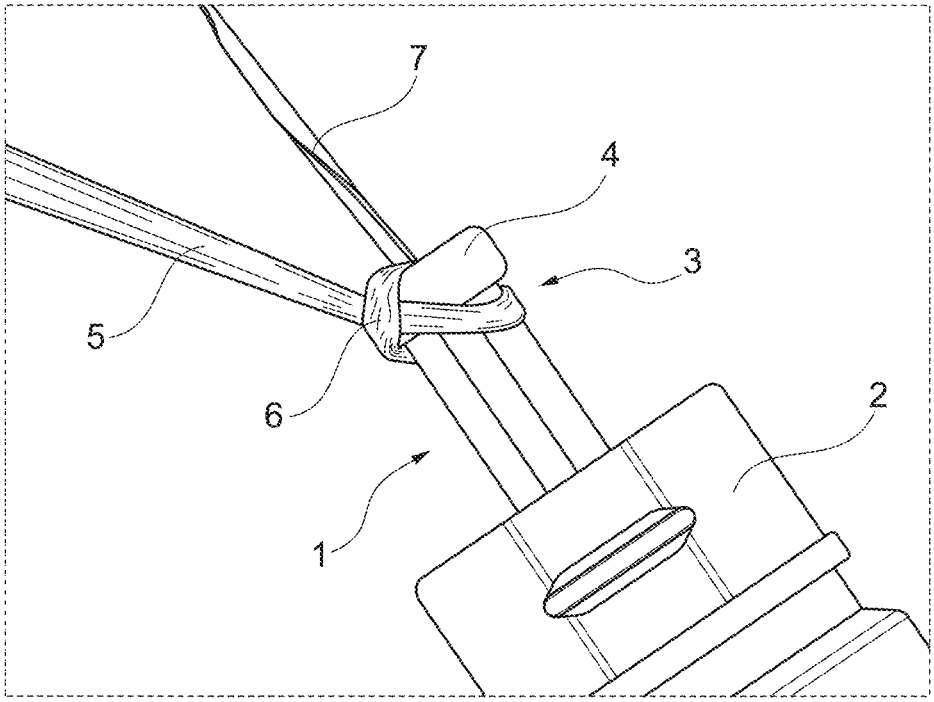
FIG. 1 shows a tube end according to an embodiment of the invention.

FIG. 1 shows a hollow RIC tube 1 positioned in a holder 2, the tube 1 having a tube end 3 provided with a flange 4. A fiber 5 inserted in the tube 1 extends out of the tube 1 and is formed in a loop around the tube end 3 such that a knot 6 to the tube end 3. Electrical wires 7 extend out of the tube 1. The tube end 3 with fiber 5 tied around it is now ready to be fixated to the outside of the tube 1 by heating. Other means of fixation may be performed by gluing and/or welding. By placement of the fiber end 5 around the outside tube end 3 and securing the fiber end 5 to the outside tube end 3, the fiber 5 is anchored to the tube 1 in such a way that the anchoring does not consume space in the passage of the tube. Accordingly, the anchoring does not take up space which is needed for the electrical wires. As a result, the tube may be relatively thin which is desirable from an aesthetic point of view.

Figure 2:
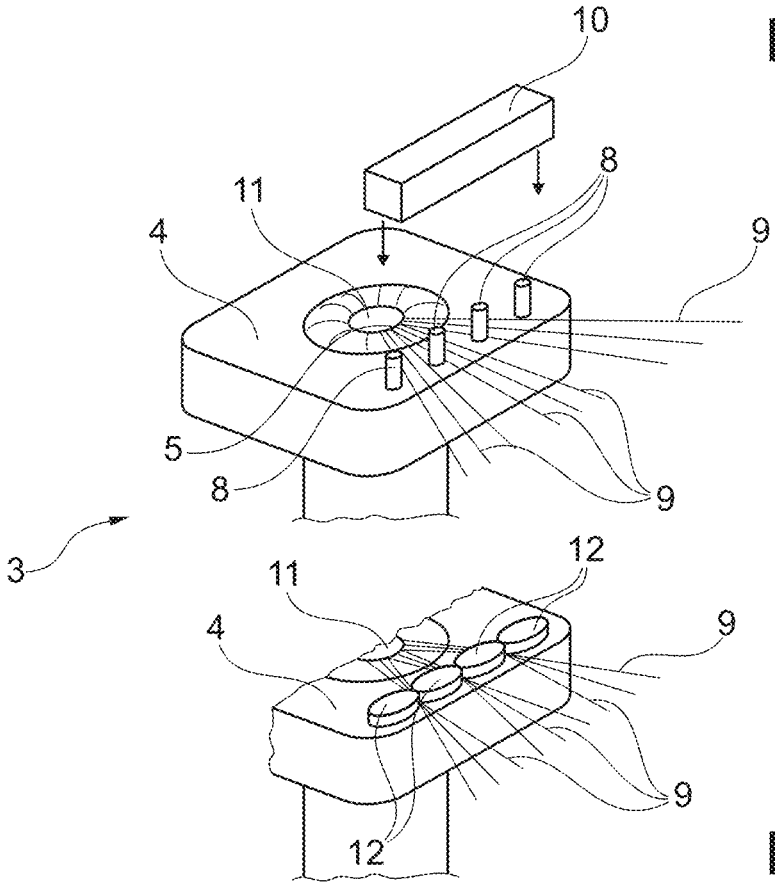
FIG. 2 shows a tube end before and after fixation by heating.

FIG. 2 shows the tube end 3 having a square shaped flange 4 that is provided with four sealing pins 8. The fiber 5 extending out of opening end 11 of the tube is frayed into filaments 9 that are placed against the flange 4 of the tube end 3 and positioned between the sealing pins 8. A heating block 10 located above the sealing pins 8 will heat up the sealing pins 8 and filaments 9 such that the filaments 9 and the sealing pins 8 merge into one material which is secure the filaments 9 to the flange 4 when pushed down thereon. As a result the sealing pins 8 are melted together with the filaments into small bumps 12.

Figure 3:
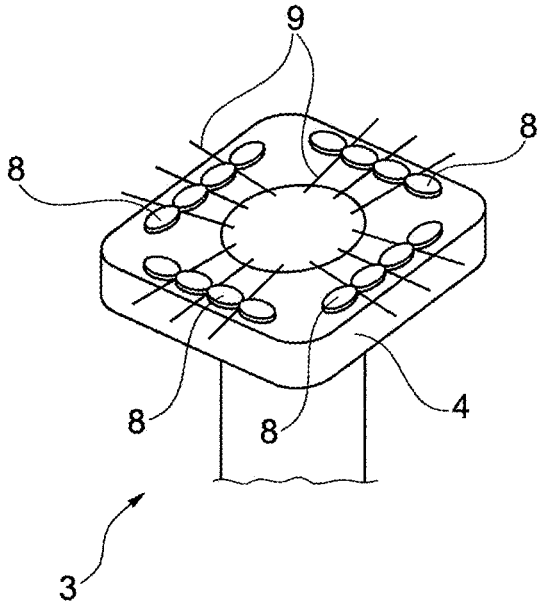
FIG. 3 shows a tube end according to an alternative embodiment of the invention.
Figure 4:
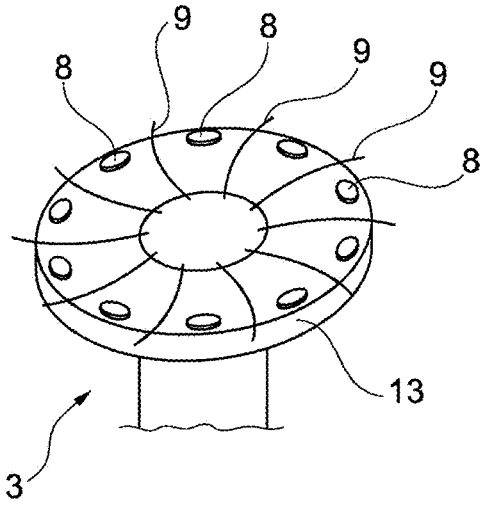
FIG. 4 shows a tube end according to another alternative embodiment of the invention.

FIG. 3 shows an alternative for positioning the sealing pins 8 about the square shaped flange 4. FIG. 4 shows an alternative for positioning sealing pins 8 about a circular shaped flange 13.

Figure 5:
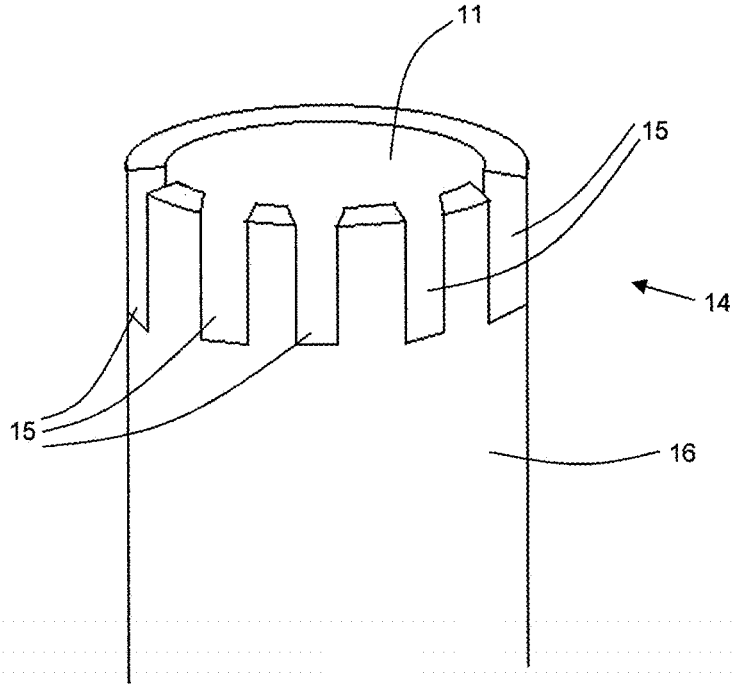
FIG. 5 shows a tube end according to yet another alternative embodiment of the invention.

FIG. 5 shows another embodiment wherein a tube end 14 of tube 16 is provided with slits 15. In this embodiment, the slits 15 are provided around the opening 11 at only one half of the circular profile of the tube 1. When the fiber 5 is frayed into filaments 9 these are positioned between the slits 15 and placed against the outer surface of the tube end 14.

Figure 6:
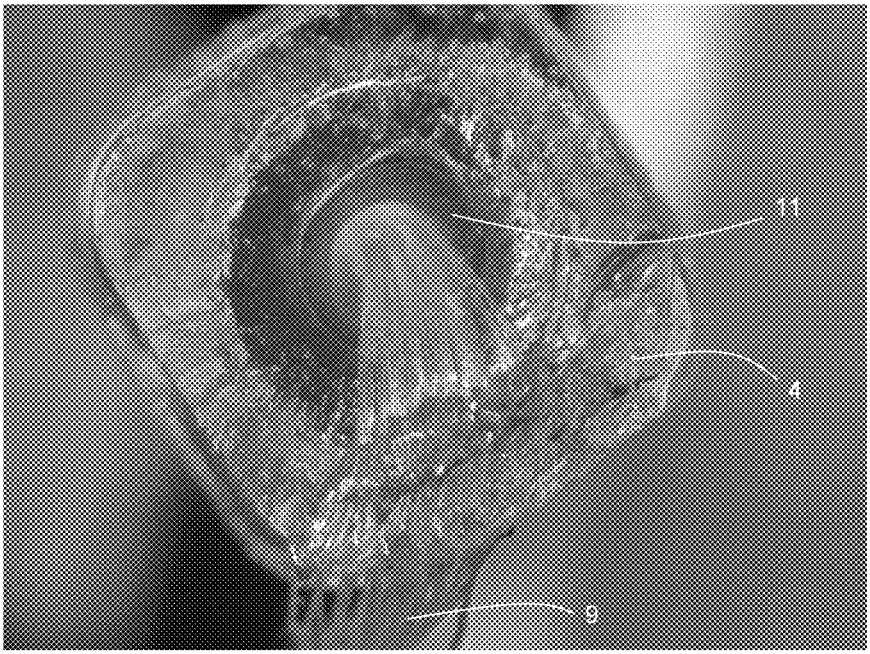
FIG. 6 shows a top view of an end result of FIG. 2.
Figure 7:
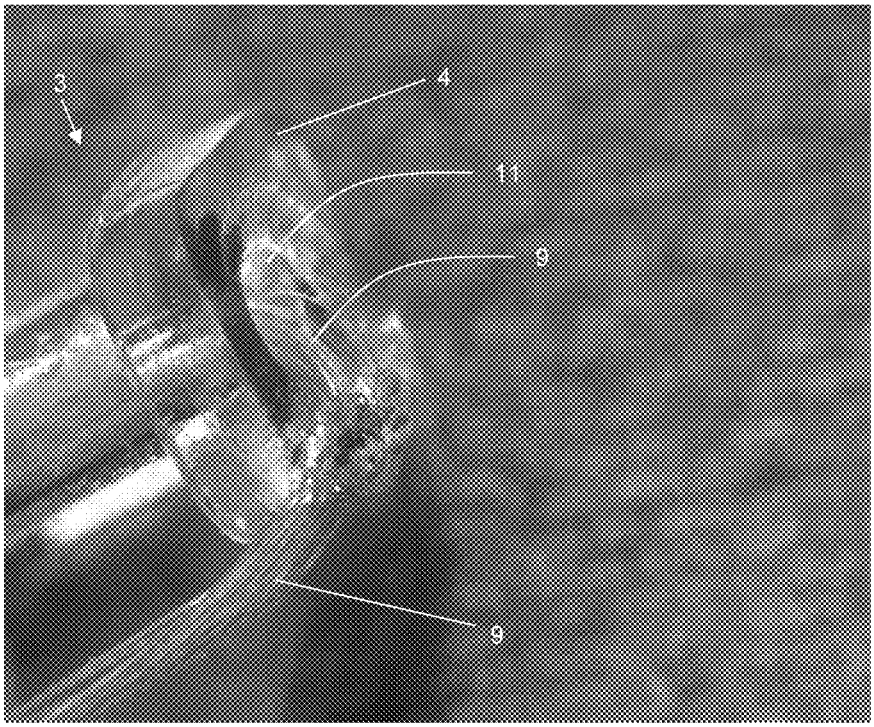
FIG. 7 shows a side view of the tube end of FIG. 6.

FIGS. 6 and 7 show the tube end 3 after fixating by heating. The filaments 9 are fixated at one side of the flange 4. The opening 11 of the tube 1 remains accessible for electrical wires to be inserted.

The invention claimed is:

1. A method for manufacturing a tube for a hearing aid, the method comprising the steps of:

providing a tube of a predetermined length, the tube defining a first tube end and an opposite second tube end;

providing a fiber having a length which exceeds the predetermined length of the tube, the fiber defining a first fiber end and an opposite second fiber end;

inserting the fiber into the tube such that the fiber ends extend out through at least one of the tube ends;

anchoring at least one of the fiber ends at the respective tube end through which it extends, wherein the anchoring comprises placing the respectiver fiber end around the respective tube end and fixating the respective fiber end to the respective tube end.

2. A method according to claim 1, wherein the anchoring further comprises, prior to the placing:

fraying the fiber end into filaments; and wherein the placing further includes positioning the filaments against the tube end.

3. A method according to claim 1, wherein the anchoring further comprises, prior to the fixating:

forming the fiber end in a loop; and placing the loop around the respective tube end.

4. A method according to claim 3, wherein the anchoring comprises, subsequent to the step of placing the loop around the respective tube end:

tightening the loop so as to tie the fiber to the respective tube end by means of a knot defined by the tied loop.

5. A method according to claim 1, wherein the step of fixating is performed by gluing and/or welding and/or soldering and/or heating.

6. A method according to claim 2, wherein the anchoring comprises, prior to the fixating:

forming the fiber end in a loop; and placing the loop around the respective tube end.

7. A method according to claim 6, wherein the anchoring comprises, subsequent to the step of placing the loop around the respective tube end:

tightening the loop so as to tie the fiber to the respective tube end by means of a knot defined by the tied loop.

8. A method according to claim 2, wherein the fixating is performed by gluing and/or welding and/or soldering and/or heating.

9. A method according to claim 2, wherein the first and/or the second tube end defines one or more slits.

10. A method according to claim 2, wherein the first and/or the second tube end defines a flange.

11. A method according to claim 10, wherein the flange defines one or more sealing pins and/or one or more slits.

12. A method according to claim 9, wherein the anchoring further comprises, prior to the step of fixating:

positioning at least a part of the filaments in one or more of the slits.

13. A method according to claim 11, wherein the anchoring further comprises, prior to the step of fixating:

positioning at least a part of the filaments in one or more of the slits.

14. A method according to claim 11, wherein the anchoring further comprises, prior to the step of fixating:

positioning the filaments between the sealing pins.

15. A method according to claim 1, wherein the first and/or the second tube end defines one or more slits.

16. A method according to claim 1, wherein the first and/or the second tube end defines a flange.

17. A Receiver-in-Canal (RIC) tube for a hearing aid, comprising:

a tube having a predetermined length, defining a first tube end and an opposite second tube end;

a fiber having a length which exceeds the predetermined length of the tube, the fiber defining a first fiber end and an opposite second fiber end, wherein the fiber is inserted in the tube such that at least one of the fiber ends extends out through at least one of the tube ends, and wherein the at least one of the fiber ends is placed around the at least one of the tube ends and is fixated to the at least one of the tube ends.

18. A RIC tube for a hearing aid according to claim 17, wherein at least one of the first tube end or the second tube end defines one or more slits.

19. A RIC tube for a hearing aid according to claim 17, wherein at least one of the first tube end or the second tube end defines a flange that defines one or more sealing pins and/or one or more slits.

* * * * *